US008261652B2

(12) United States Patent
Findlay

(10) Patent No.: US 8,261,652 B2
(45) Date of Patent: Sep. 11, 2012

(54) AMBIDEXTROUS BOLT STOP

(75) Inventor: David S. Findlay, Athol, MA (US)

(73) Assignee: Smith & Wesson Corp., Springfield, MA (US)

( * ) Notice: Subject to any disclaimer, the term of this patent is extended or adjusted under 35 U.S.C. 154(b) by 217 days.

(21) Appl. No.: 12/768,798

(22) Filed: Apr. 28, 2010

(65) Prior Publication Data

US 2010/0275485 A1 Nov. 4, 2010

Related U.S. Application Data

(60) Provisional application No. 61/174,035, filed on Apr. 30, 2009.

(51) Int. Cl.
*F41A 3/42* (2006.01)

(52) U.S. Cl. ..... 89/181; 89/137; 89/153; 89/190; 42/70.02

(58) Field of Classification Search ..... 42/16, 17, 42/70.01, 70.02; 89/137, 138, 153, 180, 89/181, 190

See application file for complete search history.

(56) References Cited

U.S. PATENT DOCUMENTS 1,651,128 A * 11/1927 Jervey ..... 89/137
3,540,142 A * 11/1970 Billett et al. ..... 42/22
4,128,042 A * 12/1978 Atchisson ..... 89/138
4,429,479 A * 2/1984 Johnson ..... 42/6
4,481,863 A * 11/1984 Zanner et al. ..... 89/138
4,521,985 A * 6/1985 Smith et al. ..... 42/7
5,513,460 A * 5/1996 Van Niekerk et al. ..... 42/70.06
5,519,954 A * 5/1996 Garrett ..... 42/6
5,551,180 A * 9/1996 Findlay et al. ..... 42/70.01
5,726,376 A * 3/1998 Menges et al. ..... 89/190
5,741,996 A * 4/1998 Ruger et al. ..... 89/196
6,257,114 B1 * 7/2001 Murello ..... 89/1.42
6,851,346 B1 * 2/2005 Herring ..... 89/1.4
7,047,864 B2 * 5/2006 Spinner et al. ..... 89/180
7,103,998 B2 * 9/2006 McGarry ..... 42/16
7,661,219 B1 2/2010 Knight, Jr. et al.
7,958,661 B2 * 6/2011 Strayer ..... 42/50
D641,451 S * 7/2011 Gomez et al. ..... D22/108
D652,468 S * 1/2012 Burt et al. ..... D22/108
2003/0208940 A1 * 11/2003 Johnson ..... 42/18
2005/0000138 A1 * 1/2005 Kiss ..... 42/50
2006/0123683 A1 * 6/2006 Garrett et al. ..... 42/6

* cited by examiner

*Primary Examiner* — Michael David
(74) *Attorney, Agent, or Firm* — Ballard Spahr LLP

(57) ABSTRACT

An ambidextrous bolt stop for use with a firearm generally includes a first bolt stop element having a bolt stop finger and a first release lever operatively connected to a left side of a receiver of the firearm and a second bolt stop element having a second release lever operatively connected to a right side of the firearm. The second bolt stop element engages the first bolt stop element via a yoke and pin type configuration interior to the receiver of the firearm. The first and second release levers include first and second buttons located exterior to the receiver on respective sides thereof to actuate the bolt stop.

16 Claims, 9 Drawing Sheets

AMBIDEXTROUS BOLT STOP

CROSS REFERENCE TO RELATED APPLICATIONS

This application claims the benefit of U.S. Provisional Application Ser. No. 61/174,035, filed on Apr. 30, 2009, which is herein incorporated by reference in its entirety.

FIELD OF THE INVENTION

The present invention relates generally to firearms and, more particularly, to an ambidextrous bolt stop for use with a firearm.

BACKGROUND OF THE INVENTION

Many firearms typically include an ammunition magazine disposed somewhere within the frame of the firearm. Rounds of ammunition stored in the magazine are individually fed from the magazine into a barrel or firing chamber, where each round is fired. With a semi-automatic firearm, such as the Smith & Wesson model M&P 15 for example, the bolt, a mechanical part of the firearm that forms the rear of the chamber as the propellant burns, cycles back and forward between each shot, propelled by recoil or expanding gas (back) or the recoil spring (forward). When the bolt moves forward, it strips a cartridge from the magazine and pushes it into the chamber. When the bolt moves back, an extractor pulls the spent casing from the chamber. Once the case is clear of the chamber, the ejector ejects the casing out of the firearm so that a new round may be chambered.

After the firing of the last round in the magazine, a "bolt stop," also known as a "bolt catch," holds the bolt in a rearwards position, as discussed below. Bolt stop devices for hand-held firearms are known in the art, especially in handgun and combat rifles. The purpose of the bolt stop device is to retain the principal members of the bolt or bolt carrier mechanism in a rearward position. Retaining the bolt or bolt carrier mechanism in this rearward position is desirable as a safety measure to allow unobstructed view of the chamber of a firearm, to provide access to the chamber area for cleaning or other maintenance, to signal to the operator that the magazine is empty, and to provide a means for rapid reloading. With respect to the last advantage, when the bolt group is held rearward upon discharge of the last round in a magazine, an operator may eject the empty magazine, insert a fresh one, and then press a button on the side of the firearm to release the bolt and resume firing rounds. The bolt stop and bolt release button save an operator time from having to rack the bolt back to load a new round, and is standard on almost all semi-automatic rifles.

Know bolt stops typically include a bolt stop release button located on one side of the firearm. The Smith & Wesson model M&P 15 , for example, has a bolt stop having a bolt stop release button located on the left side of the firearm. In this and similar firearms, the bolt stop is a pivoted part on the outside of the lower receiver and is spring biased at the bottom of the part by a plunger and a spring in the receiver. The bolt stop further has a projection that stops the rotation of the bolt stop at the rear of the magazine well of the lower receiver. This projection is also contacted by the magazine follower once the magazine box is empty of rounds. As alluded to above, the magazine spring overcomes the bolt stop spring and plunger and rotates the bolt stop upward high enough to stop the forward motion of the bolt and hold the bolt in the open position. Pushing on the bolt stop release button of the bolt stop releases the bolt to chamber a round.

For the right-handed shooter, the bolt stop release button is easily accessible, for example, with a shooter's thumb or index finger. For a left handed shooter, however, the bolt stop release button is generally not accessible without a shooter having to release his grip on the firearm. Such action may be inconvenient. Moreover, in combat situations, even right-handed shooters are sometimes forced to switch from his/her dominant shooting posture to take advantage of cover and concealment. A right-handed shooter may not be accustomed to releasing and replacing a magazine and depressing the bolt stop release button in this position, thereby costing a shooter valuable time.

An ambidextrous bolt stop would thus allow a shooter, regardless of whether he/she is right handed or left handed, and regardless of shooting posture, to quickly and easily activate the bolt stop release button to chamber a new round from either the left side or the right side of the firearm.

SUMMARY OF THE INVENTION

In view of the foregoing, it is an object of the present invention to provide an ambidextrous bolt stop for use with a firearm that can be operated from both the left and right sides of a firearm.

It is another object of the present invention to provide an ambidextrous bolt stop for use with a firearm that can be actuated with one hand.

It is another object of the present invention to provide and ambidextrous bolt stop for use with a firearm for easy use by either a right-handed shooter or a left-handed shooter.

It is another object of the present invention to provide and ambidextrous bolt stop for use with a firearm that permits unobstructed access to the chamber area for cleaning or clearing and obstruction.

It is another object of the present invention to provide an ambidextrous bolt stop for use with a firearm that provides a signal to the operator that the magazine is empty.

It is another object of the present invention to provide an ambidextrous bolt stop for use with a firearm that facilitates rapid reloading by holding the bolt group to the rear while an empty magazine is removed and a new magazine is inserted.

It is another object of the present invention to provide an ambidextrous bolt stop for use with a firearm that is essentially identical in terms of appearance and tactile feel on both sides of the firearm.

It is another object of the present invention to provide an ambidextrous bolt stop for use with a firearm that provides the same type of button release to close the bolt using the index finger of the operator's firing hand or support hand.

It is another object of the present invention to provide an ambidextrous bolt stop for use with a firearm that is substantially similar to the existing Smith & Wesson model M&P 15 bolt stop in terms of appearance, relative position on the firearm, activation method and relative button size.

According to the present invention, an ambidextrous bolt stop for use with a firearm having a receiver, a magazine well, a magazine and a firing mechanism is provided. The ambidextrous bolt stop includes a left bolt stop portion having a left side bolt stop release button and a right side bolt stop portion having a right side bolt stop release button. The right side bolt stop release button is operatively connected to the left side bolt stop release button by a yoke and pin arrangement. The lower receiver of the firearm is provided with modified receiver cuts to accommodate both the left side and right side bolt stop release buttons, so that an operator may release the bolt from either side of the firearm.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENTS

As used herein, the directional terms "front," "forward," "rear," "rearward," "upward," "downward," "right," "left," "top" and "bottom" refer to the firearm when held in the normal firing position, as would be understood by one of ordinary skill in the art.

Figure 1:
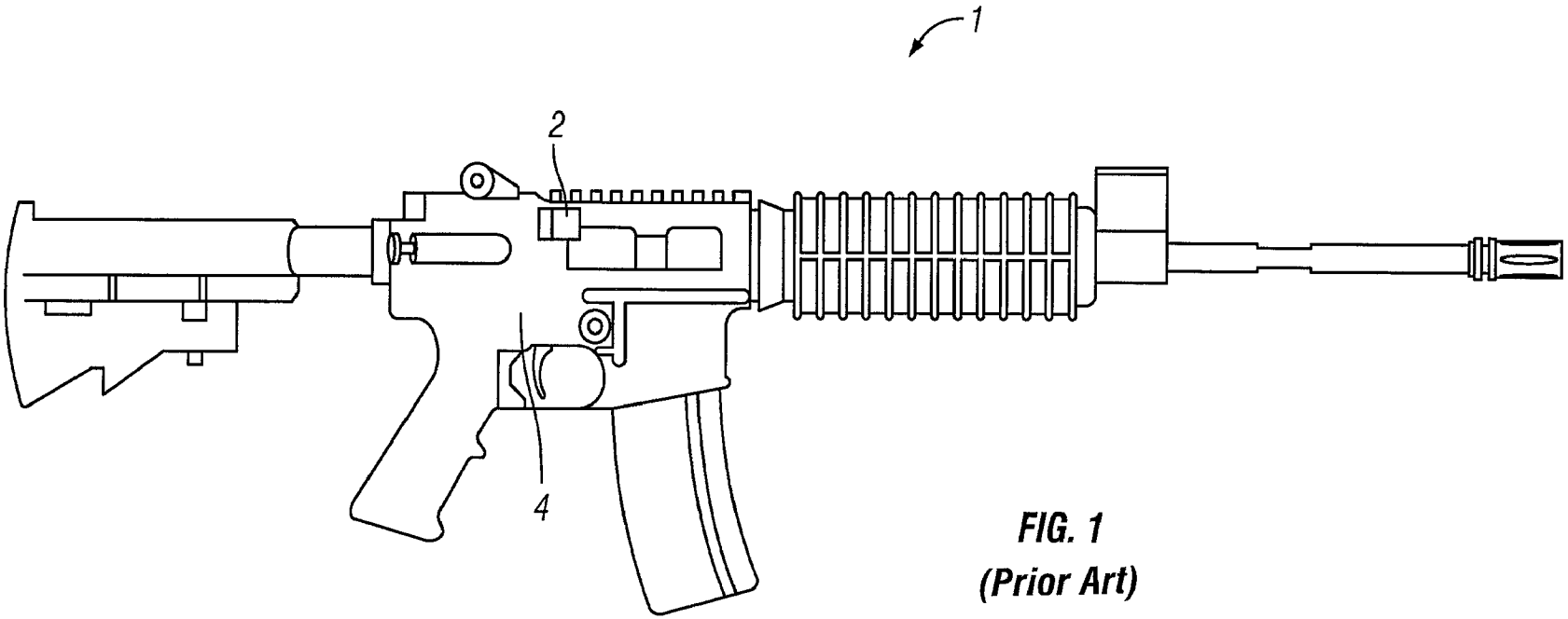
FIG. 1 (Prior Art)
FIG. 1 is a right side view of a prior art firearm.
Figure 2:
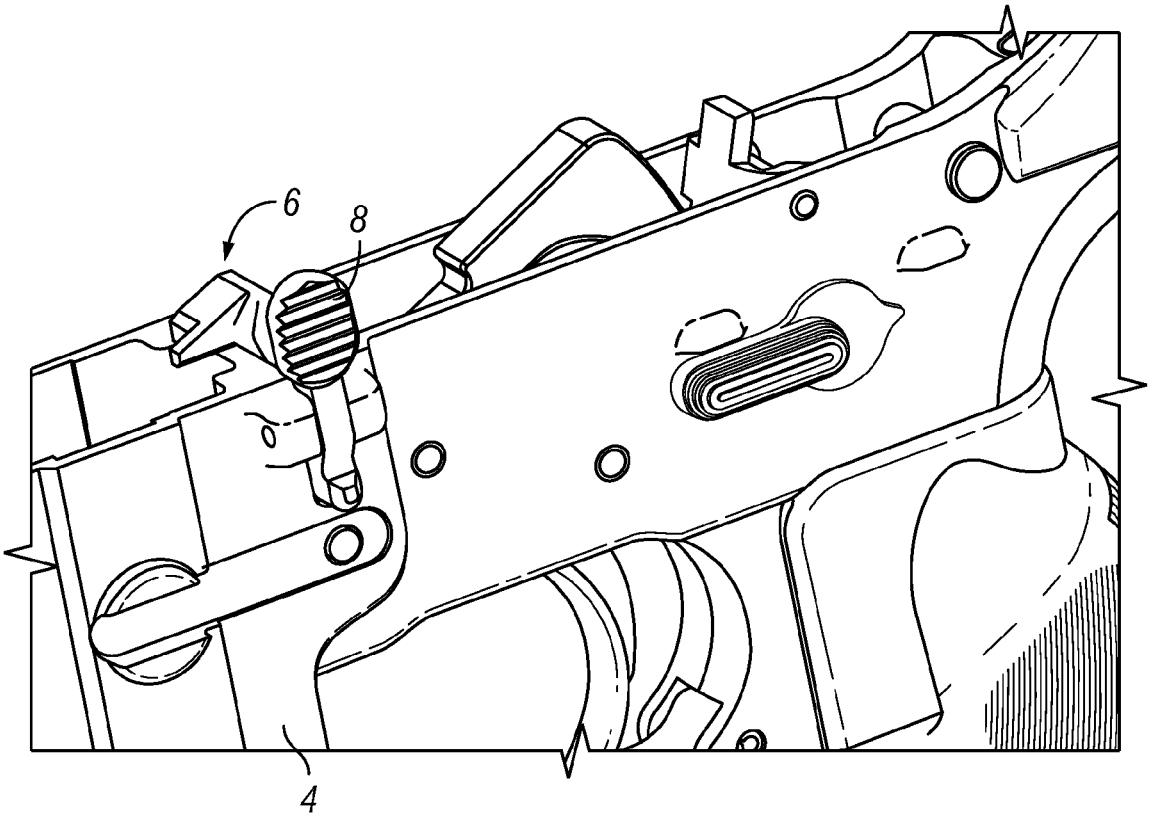
FIG. 2 (Prior Art)
FIG. 2 is an enlarged perspective view of the left side of a prior art firearm having a prior art bolt stop and left side bolt stop release button.
Figure 3:
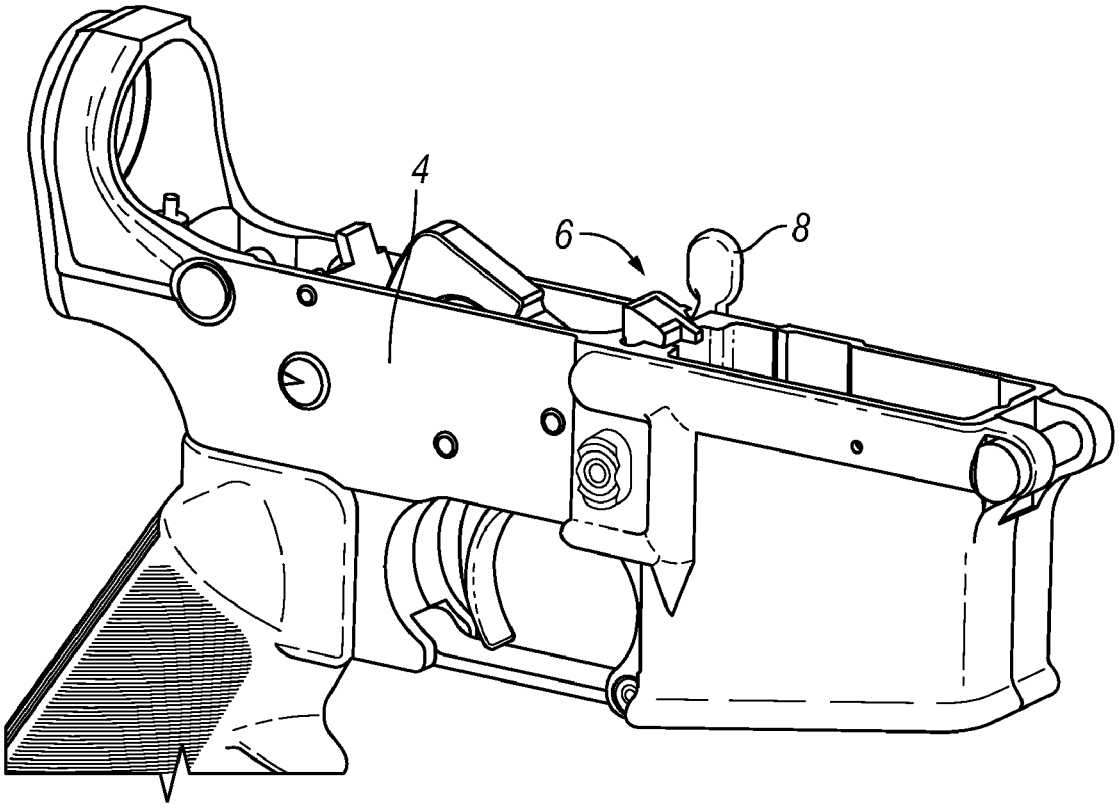
FIG. 3 (Prior Art)
FIG. 3 is an enlarged perspective view of the right side of a prior art firearm having a prior art bolt stop and left side bolt stop release button.

FIG. 1 shows a prior art firearm 1, specifically a Smith & Wesson model M&P 15, having an upper receiver 2 and a lower receiver 4. More particularly, FIG. 1 is a right side view of such firearm. FIGS. 2 and 3 are left and right side views, respectively of the firearm of FIG. 1 having a bolt stop 6 and bolt stop release button 8 located on the left side thereof. As will be readily appreciated, the bolt stop release button 8 of the prior art firearm 1 may only be accessed from the left side of the firearm, leading to difficulty for left-handed shooters and confusion for right-handed shooters shooting in abnormal or non-customary positions.

Figure 4:
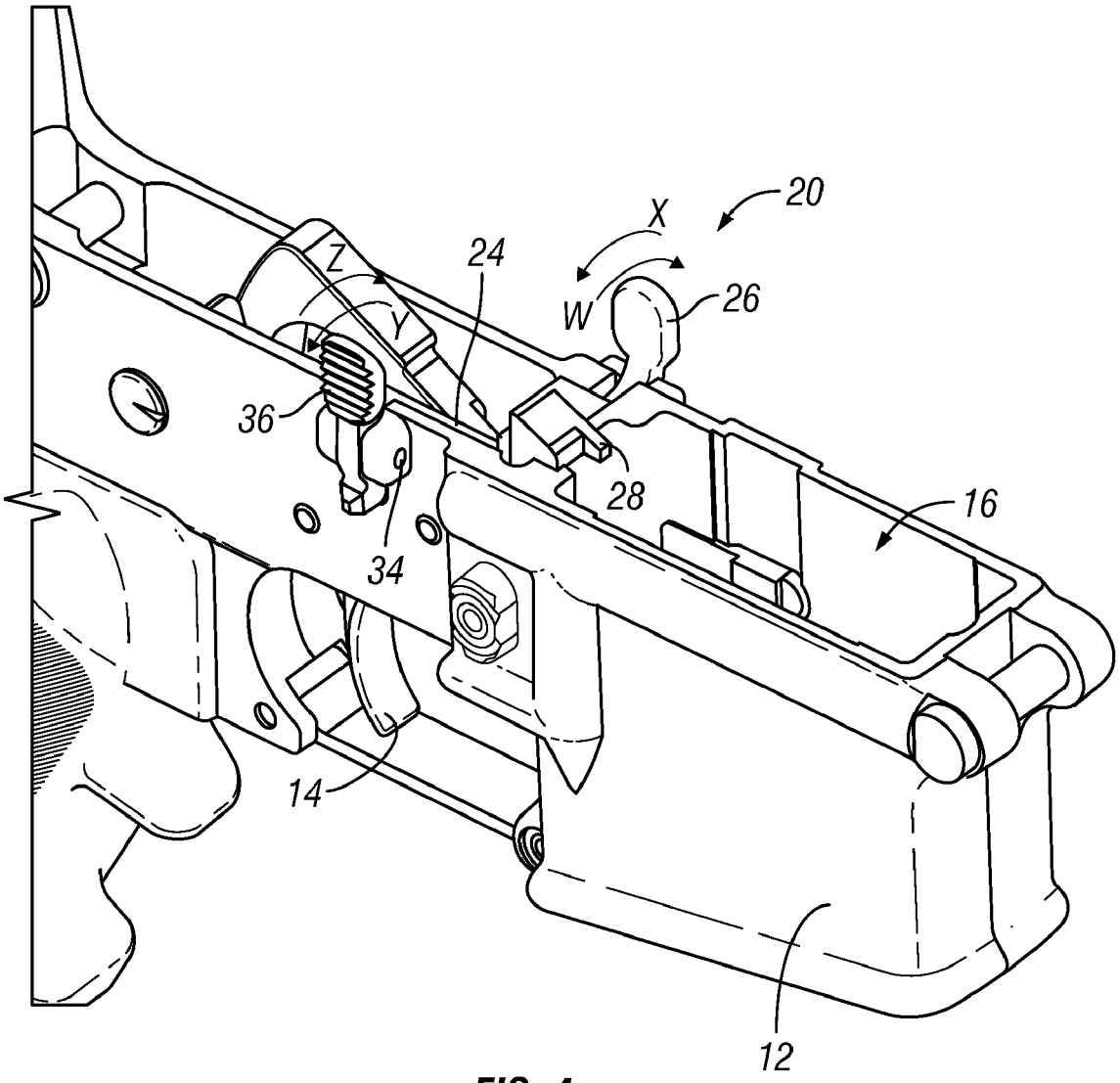
FIG. 4 is an enlarged perspective view of the right side of a firearm having an ambidextrous bolt stop in accordance with the present invention.
Figure 5:
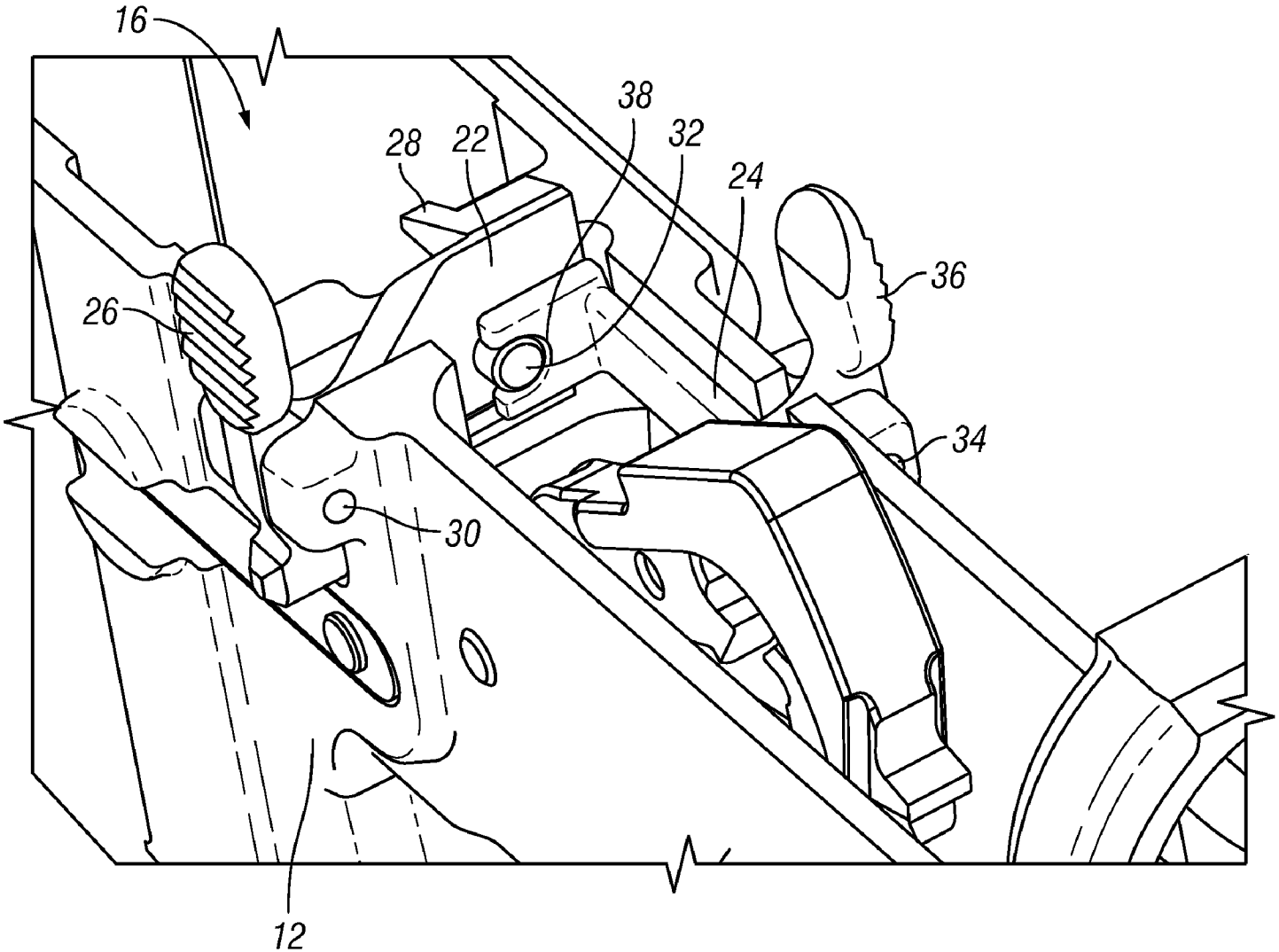
FIG. 5 is an enlarged perspective view of the firearm of FIG. 3 having an ambidextrous bolt stop in accordance with the present invention.
Figure 6:
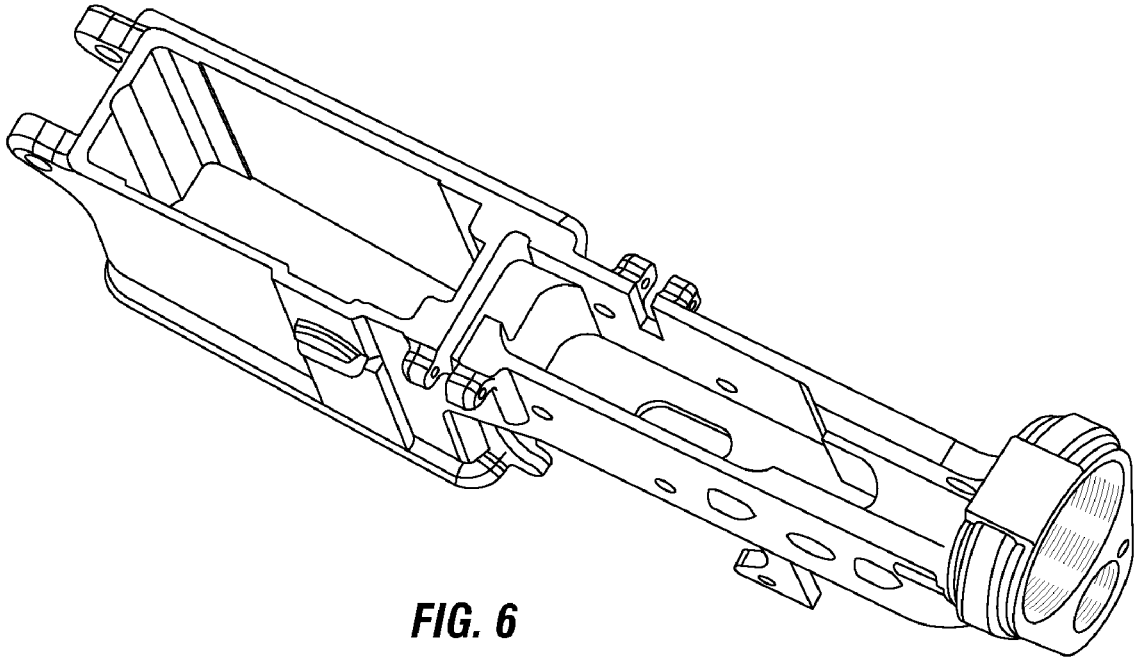
FIG. 6 is a perspective view of a lower receiver of a firearm configured to accommodate the ambidextrous bolt stop in accordance with the present invention.
Figure 7:
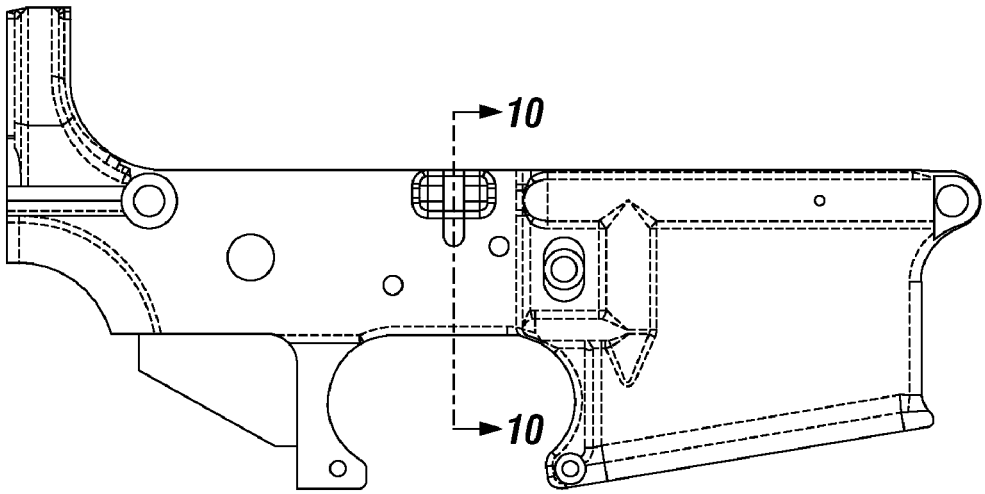
FIG. 7 is a right side elevational view of the lower receiver of FIG. 6 in accordance with the present invention.
Figure 8:
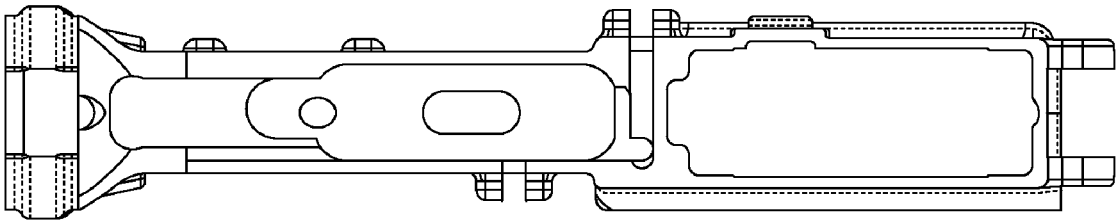
FIG. 8 is a top plan view of the lower receiver of FIG. 6 in accordance with the present invention.
Figure 9:
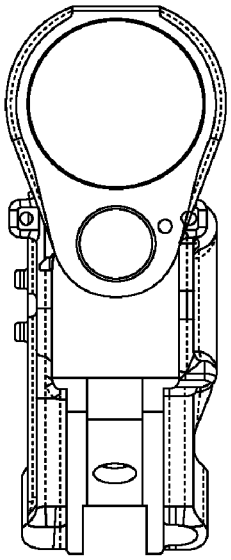
FIG. 9 is a rear elevational view of the lower receiver of FIG. 6 in accordance with the present invention.
Figure 10:
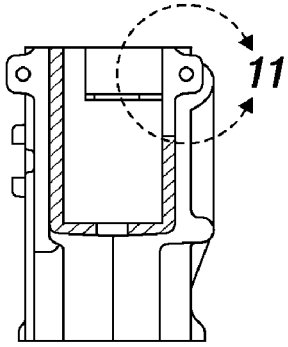
FIG. 10 is a cross-sectional view of the lower receiver of FIG. 6 taken along line A-A in accordance with the present invention.
Figure 11:
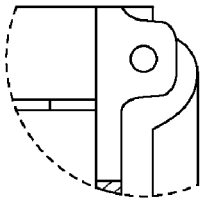
FIG. 11 is an enlarged view of area X of FIG. 10 in accordance with the present invention.
Figure 12:
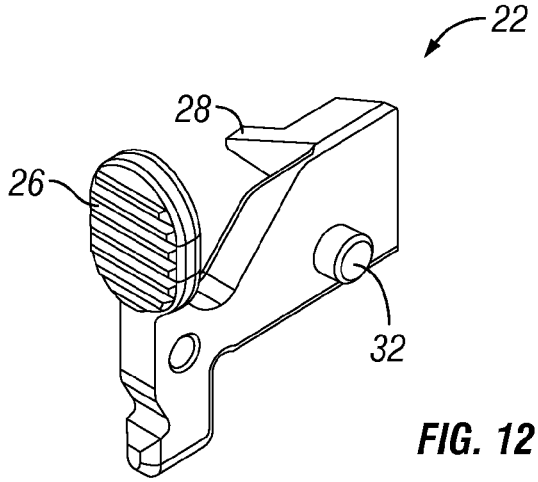
FIG. 12 is a perspective view of the left bolt stop portion of the ambidextrous bolt stop in accordance with the present invention.
Figure 13:
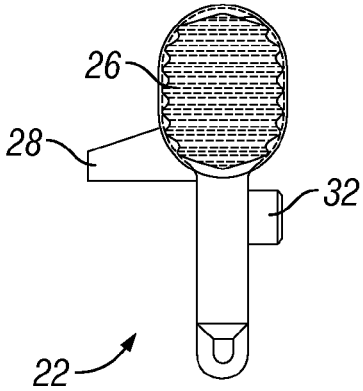
FIG. 13 is a front elevational of the left bolt stop portion of FIG. 12 in accordance with the present invention.
Figure 14:
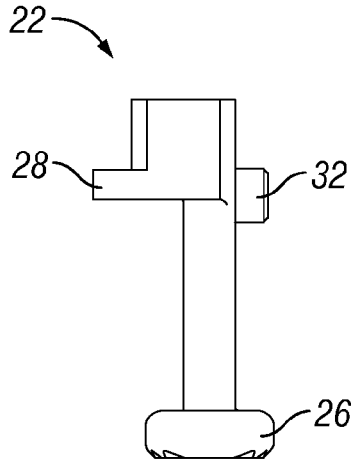
FIG. 14 is a top plan view of the left bolt stop portion of FIG. 12 in accordance with the present invention.
Figure 15:
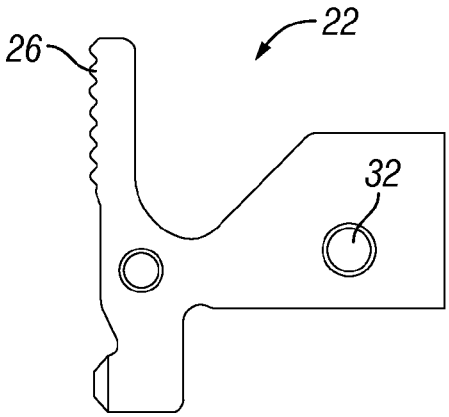
FIG. 15 is a right side elevational view of the left bolt stop portion of FIG. 12 in accordance with the present invention.
Figure 16:
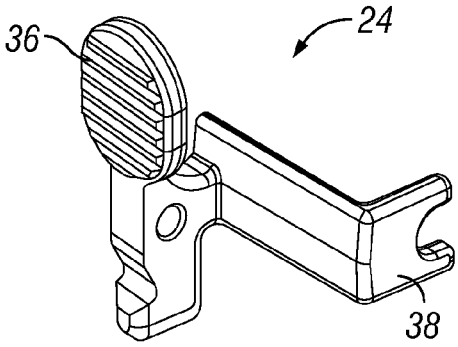
FIG. 16 is a perspective view of the right bolt stop portion of the ambidextrous bolt stop in accordance with the present invention.
Figure 17:
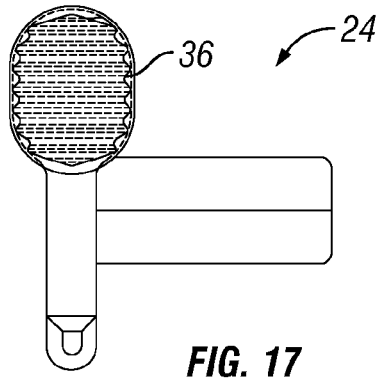
FIG. 17 is a front elevational view of the right bolt stop portion of FIG. 16 in accordance with the present invention.
Figure 18:
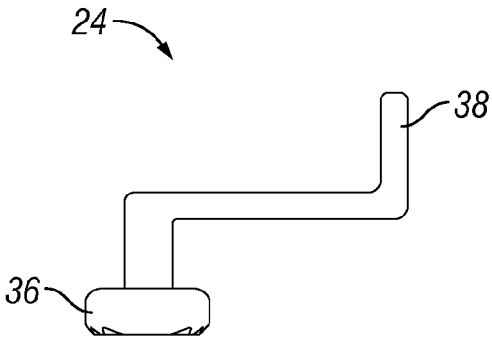
FIG. 18 is a top plan view of the right bolt stop portion of FIG. 16 in accordance with the present invention.
Figure 19:
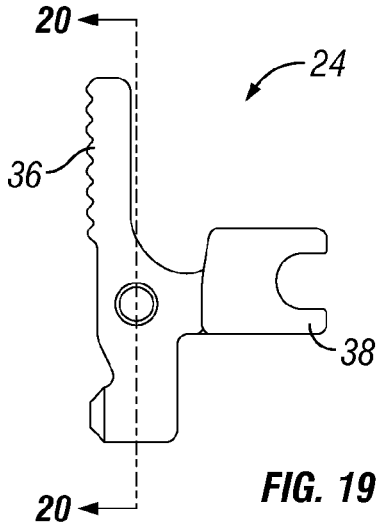
FIG. 19 is a right side elevational view of the right bolt stop portion of FIG. 16 in accordance with the present invention.
Figure 20:
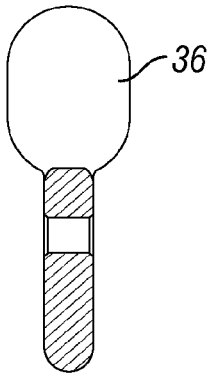
FIG. 20 is a cross-sectional view of the right bolt stop portion of FIG. 16 taken along line A-A in accordance with the present invention.
Figure 21:
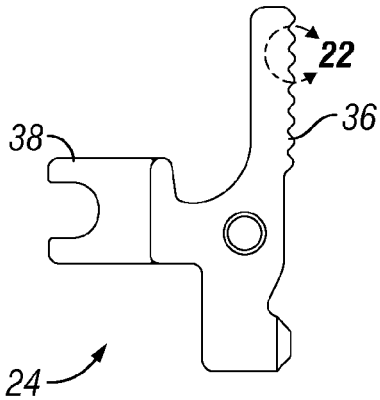
FIG. 21 is a left side view of the right bolt stop portion of FIG. 16 in accordance with the present invention.
Figure 22:
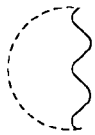
FIG. 22 is an enlarged view of area Z of FIG. 21 in accordance with the present invention

The ambidextrous bolt stop of the present invention solves these problems by providing a mechanism that can be actuated from either side of the firearm, lending to ease of use by right-handed and left-handed shooters alike. In FIGS. 4 and 5 a lower receiver 12 of a firearm is shown including a trigger 14, a magazine well 16 and an ambidextrous bolt stop 20. As shown therein, the ambidextrous bolt stop according to the present invention includes a left bolt stop portion 22 and a right bolt stop portion 24.

As best shown in FIGS. 4, 5 and 12-15, the left bolt stop portion 22 is substantially similar to the prior art bolt stop described above. As shown therein, the left side bolt stop portion 22 includes a bolt stop finger 28 in communication with the magazine well 16 for detecting when a magazine is empty and for retaining the bolt in a rearward position, as discussed below, a release lever integral with the bolt stop finger 28, and left side bolt stop release button 26 integral with the release lever. The left side bolt stop portion 22 is pivotally connected to the left side of the receiver 12 via horizontal pivot pin 30 such that it may rotate relative to the receiver 12 about pin 30. Importantly, the left bolt stop portion 22 also includes a pin 32 provided on a rearward facing surface thereof for cooperation with a complimentary yoke 38 on the right bolt stop portion 24, as discussed below. Bolt stop finger or projection 28 stops the rotation of the bolt stop at the rear of the magazine well of the lower receiver 12. A plunger and spring (not show) interior of the lower receiver 12 spring biases the left side bolt stop portion 22 at a bottom portion thereof such that the finger portion 28 is held in a downward, unblocked position.

As best shown in FIGS. 4, 5 and 16-22, the right bolt stop portion 24 is similar to the left bolt stop portion 22 described above. As shown therein, the right side bolt stop portion 24 includes a release lever having a right side bolt stop release button 36 integral with the lever. The right side bolt stop portion 24 is pivotally connected to the right side of the receiver 12 via horizontal pivot pin 34 such that it may rotate relative to the receiver 12 about pin 34. The right side bolt stop release button 36 is substantially identical to the left side bolt stop release button 26. Preferably, both the left and right side release buttons 26, 36 are knurled pads providing a gripping surface for a user's finger. The right side bolt stop portion 24 also includes a yoke 38 formed on an end of bolt stop portion 24 opposite the release button 36 for engaging the rearwards facing pin 32 of the left bolt stop portion 22.

In operation, the right bolt stop portion 24 senses the position of the left bolt stop portion 22 through the yoke 38 and pin 32 arrangement. In the preferred embodiment, the rearwards facing pivot pin 32 of the left bolt stop portion 22 indexes into the yoke 38 of the right bolt stop portion 24. This forces both bolt stop portions 22.24 to move in unison and to exhibit the same relative positions at all times. For example, if one bolt stop portion is pivoted outward, such as when the last round in a magazine is fired and the bolt stop finger 28 is moved upwards by the magazine follower, then so is the bolt stop portion on the other side, and vice versa; if one portion is vertical, so is the other. Importantly, the left bolt stop portion 22 is the portion of the ambidextrous bolt stop 20 that stops the bolt, just like the current Smith & Wesson model M&P 15 design as discussed above. As such, with the ambidextrous bolt stop of the present invention, releasing the bolt can now occur using either side button release that the shooter chooses.

When all components are assembled in the lower receiver 12 of the firearm, and there is a magazine removably attached to the lower receiver 12 and in communication with the magazine well 16, the ambidextrous bolt stop 20 functions as follows. First, the bolt of the firearm travels past the bolt stop finger 28 when the final round of ammunition is fired or when the shooter pulls release buttons 26 or 36 laterally away from the side of the lower receiver causing the bolt stop finger 28 to rotate upward and stop the bolt from traveling forward.

When the bolt moves rearward over an empty magazine cartridge, the magazine spring pushes the magazine follower (not shown) against the bolt stop finger 28, which mechanically creates a rotational action that causes the bolt stop finger 28 to rotate upward, block the forward movement of the bolt and signal to the shooter that the magazine is empty and needs to be replaced or refilled. When the next ammunition round is placed into the firearm, the bolt must be released from the bolt stop finger 28 to allow the bolt to push the ammunition into the chamber of the firearm. In particular, when a magazine is empty of rounds, the magazine spring overcomes the bolt stop spring and plunger (not shown), and pushes bolt stop finger 28 upwards in the direction of arrow A to a point high enough to stop the forward motion of the bolt and hold the bolt in an open or rearward position. This upwards movement of finger 28 also causes left bolt stop portion 22, including release button 26, to rotate away from the receiver 12 about pin 30 in the direction of arrow W. As a result of the engagement of the left and right bolt stop portions 22.24 through the yoke and pin connection, right side bolt stop portion 24 and release button 36 is similarly caused to rotate away from the receiver about pin 34 in the direction of arrow Y.

A shooter would then insert a new magazine and depress the left side release button 26 or right side release button 36 towards the receiver to release the bolt and/or bolt carrier for firing. Pushing on the left side bolt stop release button 26 causes the left side bolt stop portion 22 to rotate in the direction of arrow X about pivot pin 30 such that the bolt stop finger 28 is rotated downwards and out of engagement with the bolt, thereby releasing the bolt so that a new round may be stripped from the new magazine and chambered. Pushing on the left side release button 26 also causes the right side bolt stop portion 24 to rotate about pivot pin 34 in the direction of arrow Z as a result of the yoke and pin connection.

Similarly, pushing on the right side bolt stop release button 36 causes the right side bolt stop portion 24 to rotate in the direction of arrow Z about pivot pin 34 such that the left side bolt stop portion 22, including bolt stop finger portion 28, is rotated downwards and out of engagement with the bolt in the direction of arrow X, thereby releasing the bolt so that a new round may be stripped from the new magazine and chambered. As will be readily appreciated, complimentary rotation of the left side bolt portion 22, and thus downward, unblocking movement of the bolt stop finger 28, is achieved by the pin and yoke connection, as discussed above.

As shown in FIGS. 6-10, the receiver of the firearm of the present invention has cut-outs or relieved clearance portions to accommodate the left bolt stop portion 22 and right bolt stop portion 24, and respective left and right bolt stop release buttons 26.36.

One advantage of this design is that it provides the same type of button release to close the bolt using the index finger of the shooter's firing hand or support hand. The ambidextrous bolt stop is the same as the prior art design discussed above in terms of appearance, position on the firearm, activation method (pushing a button inward) and relative button size. These advantages eliminate operator confusion in times of stress and provide similarity in training the operator in the ambidextrous bolt stop's use.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. An ambidextrous bolt stop for a firearm having a receiver, a barrel, a bolt and a magazine well for accepting a magazine, said bolt stop comprising:

a first bolt stop element operatively connected to a first side of said receiver, said first bolt stop element including a bolt stop finger in communication with said magazine well and a first release lever integral to a said bolt stop finger; and a second bolt stop element operatively connected to a second side of said receiver, said second bolt stop element including a second release lever, said second release lever engaging said first release lever through a yoke and pin connection for effecting mutual rotation of said first and second bolt stop elements relative to said receiver.

2. The ambidextrous bolt stop of claim 1, wherein said first bolt stop element is pivotally connected to said receiver by a first pivot pin.

3. The ambidextrous bolt stop of claim 1, wherein said second bolt stop element is pivotally connected to said receiver by a second pivot pin.

4. The ambidextrous bolt stop of claim 1, wherein said first bolt stop element further includes a first button exterior to said receiver for actuating said bolt stop.

5. The ambidextrous bolt stop of claim 4, wherein said second bolt stop element includes a second button exterior to said receiver for actuating said bolt stop.

6. The ambidextrous bolt stop of claim 5, wherein said first button and said second button are substantially identical in appearance.

7. The ambidextrous bolt stop of claim 5, wherein said first button and said second button are substantially identical in tactile feel.

8. The ambidextrous bolt stop of claim 5, wherein said bolt stop is movable between a first position, in which a portion of said bolt stop finger holds said bolt of said firearm in a rearward position, and a second position in which said bolt is permitted to cycle between said rearward position and a forward position.

9. The ambidextrous bolt stop of claim 8, wherein depression of either of said first and second buttons towards said receiver of said firearm causes said bolt stop to move from said first position to said second position.

10. A firearm having an ambidextrous bolt stop, comprising:

a receiver;

a barrel;

a bolt;

a magazine well formed in said receiver;

a first bolt stop element operatively connected to a first side of said receiver, said first bolt stop element including a bolt stop finger in communication with said magazine well and a first release lever integral to a said bolt stop finger; and a second bolt stop element operatively connected to a second side of said receiver, said second bolt stop element including a second release lever, said second release lever engaging said first release lever through a yoke and pin connection for effecting mutual rotation of said first and second bolt stop elements relative to said receiver.

11. The firearm of claim 10, wherein said first bolt stop element is pivotally connected to said first side of said receiver by a first pivot pin and said second bolt stop element is pivotally connected to said second side of said receiver by a second pivot pin.

12. The firearm of claim 10, wherein said first bolt stop element further includes a first button exterior to said first side of said receiver for actuating said bolt stop and said second bolt stop element includes a second button exterior to said second side of said receiver for actuating said bolt stop.

13. The firearm of claim 12, wherein said first button and said second button are substantially identical in appearance.

14. The firearm of claim 12, wherein said first button and said second button are substantially identical in tactile feel.

15. The firearm of claim 12, wherein said bolt stop is movable between a first position, in which a portion of said bolt stop finger holds said bolt of said firearm in a rearward position, and a second position in which said bolt is permitted to cycle between said rearward position and a forward position.

16. The firearm of claim 15, wherein depression of either of said first and second buttons towards said receiver of said firearm causes said bolt stop to move from said first position to said second position.

* * * * *